US008169158B2

(12) United States Patent
Iwamoto

(10) Patent No.: US 8,169,158 B2
(45) Date of Patent: May 1, 2012

(54) COLD CATHODE TUBE LIGHTING DEVICE

(75) Inventor: Kenichi Iwamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 419 days.

(21) Appl. No.: 12/524,724

(22) PCT Filed: Jan. 24, 2008

(86) PCT No.: PCT/JP2008/050955

§ 371 (c)(1),
(2), (4) Date: Jul. 28, 2009

(87) PCT Pub. No.: WO2008/093587

PCT Pub. Date: Aug. 7, 2008

(65) Prior Publication Data

US 2010/0134045 A1 Jun. 3, 2010

(30) Foreign Application Priority Data

Jan. 29, 2007 (JP) ..... 2007-017542

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/297; 315/294; 315/302; 315/307

(58) Field of Classification Search ..... None
See application file for complete search history.

(56) References Cited

U.S. PATENT DOCUMENTS

| | | | | |
|---|---|---|---|---|
| 4,912,368 | A * | 3/1990 | Nishiyama et al. | 315/58 |
| 7,227,315 | B2 * | 6/2007 | Shinbo et al. | 315/224 |
| 2007/0001627 | A1 * | 1/2007 | Lin et al. | 315/316 |

FOREIGN PATENT DOCUMENTS

| | | | |
|---|---|---|---|
| JP | 63-150926 | U | 10/1988 |
| JP | 04-116399 | U | 10/1992 |
| JP | 10-177170 | A | 6/1998 |
| JP | 2000-123988 | A | 4/2000 |

OTHER PUBLICATIONS

Official Communication issued in International Patent Application No. PCT/JP2008/050955, mailed on Mar. 25, 2008.

* cited by examiner

*Primary Examiner* — Anh Tran
(74) *Attorney, Agent, or Firm* — Keating & Bennett, LLP

(57) ABSTRACT

A cold cathode tube lighting device prevents emission-position-dependent unevenness from occurring in the brightness of light emitted from the cold cathode tube lighting device and includes a plurality of discharge tubes connected in parallel; ballast capacitors each integrally attached to a respective one of the plurality of discharge tubes; power supplies arranged to supply power to the plurality of discharge tubes; and a voltage detection unit connected to the plurality of discharge tubes to detect voltages between pairs of internal electrodes of the plurality of discharge tubes. The power supply to the plurality of discharge tubes is controlled according to the voltages detected by the voltage detection unit.

4 Claims, 4 Drawing Sheets

COLD CATHODE TUBE LIGHTING DEVICE

BACKGROUND OF THE INVENTIOIN

1. Field of the Invention

The present invention relates to a cold cathode tube lighting device. More particularly, the present invention relates to a cold cathode tube lighting device provided with a plurality of discharge tubes connected in parallel.

2. Description of the Related Art

Cold cathode tube lighting devices have conventionally been used as light sources for various devices. As conventional examples, there are known cold cathode tube lighting devices that can be used as light sources (backlights) for liquid crystal display devices.

The discharge tube of the conventional cold cathode tube lighting device is, in terms of an equivalent circuit, a resistor whose resistance decreases non-linearly as current increases and has a non-linear negative impedance characteristic like the V-I characteristic shown in FIG. 4. Thus, when an attempt is made to drive a plurality of discharge tubes connected in parallel, there arises the following problem. That is, when an attempt is made to drive a plurality of discharge tubes connected in parallel, after the voltage across one predetermined discharge tube reaches the withstand voltage (the voltage that causes insulation breakdown), the voltage across that one predetermined discharge tube decreases owing to the non-linear negative impedance characteristic. Here, voltages across the other discharge tubes are equal to the voltage across the one predetermined discharge tube, and thus the voltages across the other discharge tubes do not reach the withstand voltage. This makes it difficult to light all of the plurality of discharge tubes.

One possible way to solve the problem just described is to connect separate inverter power supplies to each one of the plurality of discharge tubes. This, however, leads to disadvantages such as increased size and cost of cold cathode tube lighting devices.

To cope with this, cold cathode tube lighting devices provided with a discharge tube having a ballast capacitor connected thereto have conventionally been proposed (for example, see JP-A-H10-177170). The cold cathode tube lighting device according to JP-A-H10-177170, in terms of an equivalent circuit, has a capacitor connected to a resistor whose resistance non-linearly decreases with increase in current, and thus has a non-linear positive impedance characteristic like the V-I characteristic shown in FIG. 5. Thus, according to JP-A-H10-177170, when a plurality of discharge tubes connected in parallel are driven, all of the plurality of discharge tubes can be lit.

With the conventional cold cathode tube lighting device provided with a plurality of discharge tubes connected in parallel, even when a failure occurs in any of the plurality of discharge tubes, the lighting operation of the cold cathode tube lighting device continues to be performed without stopping if the other discharge tubes are operating normally. Thus, the conventional cold cathode tube lighting device is inconvenient in that it continues its lighting operation in a state in which there exist one or more discharge tubes that are unlit or degraded in brightness. This leads to a problem of emission-position-dependent unevenness occurring in the brightness of light emitted from the cold cathode tube lighting device.

Furthermore, when the conventional cold cathode tube lighting device is used as a backlight for a liquid crystal display device, emission-position-dependent unevenness occurring in the brightness of light emitted from the cold cathode tube lighting device leads to an inconvenience of degraded display quality of the liquid crystal display device.

SUMMARY OF THE INVENTION

Accordingly, preferred embodiments of the present invention provide a cold cathode tube lighting device that prevents emission-position-dependent unevenness from occurring in the brightness of light emitted from the cold cathode tube lighting device.

According to a preferred embodiment of the present invention, a cold cathode tube lighting device includes: a plurality of discharge tubes that are connected in parallel and each have a pair of internal electrodes; ballast capacitors each integrally attached to at least a respective one of the plurality of discharge tubes; a power supply arranged to supply power to the plurality of discharge tubes; and voltage detection units connected to the plurality of discharge tubes to detect voltages between the pair of internal electrodes of the discharge tubes. Power supply to the plurality of discharge tubes is preferably controlled according to the voltages detected by the voltage detection units.

In the cold cathode tube lighting device according to a preferred embodiment of the present invention, as described above, the voltage detection units arranged to detect voltages between the pair of internal electrodes of the discharge tubes are connected to the plurality of discharge tubes, and thus voltages between the pair of internal electrodes of the plurality of discharge tubes can be separately detected. Power supply to the plurality of discharge tubes is preferably controlled according to the voltages detected by the voltage detection units. With this structure, when a failure occurs in any of the plurality of discharge tubes, a voltage detection unit connected to such a discharge tube detects an abnormal voltage, and thus the power supply to the plurality of discharge tubes can be cut off even when the other discharge tubes are in normal operation. In this way, the cold cathode tube lighting device is prevented from continuing its lighting operation in a state in which there exist one or more discharge tubes that are unlit or degraded in the brightness. This makes it possible to prevent emission-position-dependent unevenness from occurring in the brightness of light emitted from the cold cathode tube lighting device.

Thus, the cold cathode tube lighting device according to a preferred embodiment of the present invention prevents emission-position-dependent unevenness from occurring in the brightness of light emitted from the cold cathode tube lighting device, and thus the cold cathode tube lighting device, used as a backlight for a liquid crystal display device, helps prevent degradation in display quality of the liquid crystal display device.

In the cold cathode tube lighting device according to a preferred embodiment of the present invention, it is preferable that power supply to the plurality of discharge tubes is cut off when at least one of the voltages detected by the voltage detection units is out of a predetermined range, and that the predetermined range is set such that a voltage detected by any of the voltage detection units that is connected to an abnormal discharge tube of the plurality of discharge tubes is out of the predetermined range and such that a voltage detected by any of the voltage detection units that is connected to a normal discharge tube of the plurality of discharge tubes is within the predetermined range. With this structure, when a failure occurs in any of the plurality of discharge tubes, power supply to the plurality of discharge tubes can be easily cut off.

In the cold cathode tube lighting device according to a preferred embodiment of the present invention, it is preferable that, in a case where a deviation value of at least one of the voltages detected by the voltage detection units is larger than a predetermined value, power supply to the plurality of discharge tubes be cut off. With this structure, it is possible to prevent the lighting operation of the cold cathode tube lighting device from continuing to be performed with considerable unevenness occurring in the brightness of the plurality of discharge tubes. This makes it possible to more effectively prevent emission-position-dependent unevenness from occurring in the brightness of light emitted from the cold cathode tube lighting device.

It is preferable that the cold cathode tube lighting device according to a preferred embodiment of the present invention further includes a feedback control unit to which the voltages detected by the voltage detection units are fed, and that the feedback control unit control power supply to the plurality of discharge tubes. With this structure, the power supply to the plurality of discharge tubes can be easily controlled according to the voltages detected by the voltage detection units.

According to various preferred embodiments of the present invention, as described above, there can be easily obtained a cold cathode tube lighting device capable of preventing emission-position-dependent unevenness from occurring in the brightness of light emitted from the cold cathode tube lighting device.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First, a description will be given of the structure of a cold cathode tube lighting device of a preferred embodiment of the present invention with reference to FIGS. 1 and 2.

Figure 1:
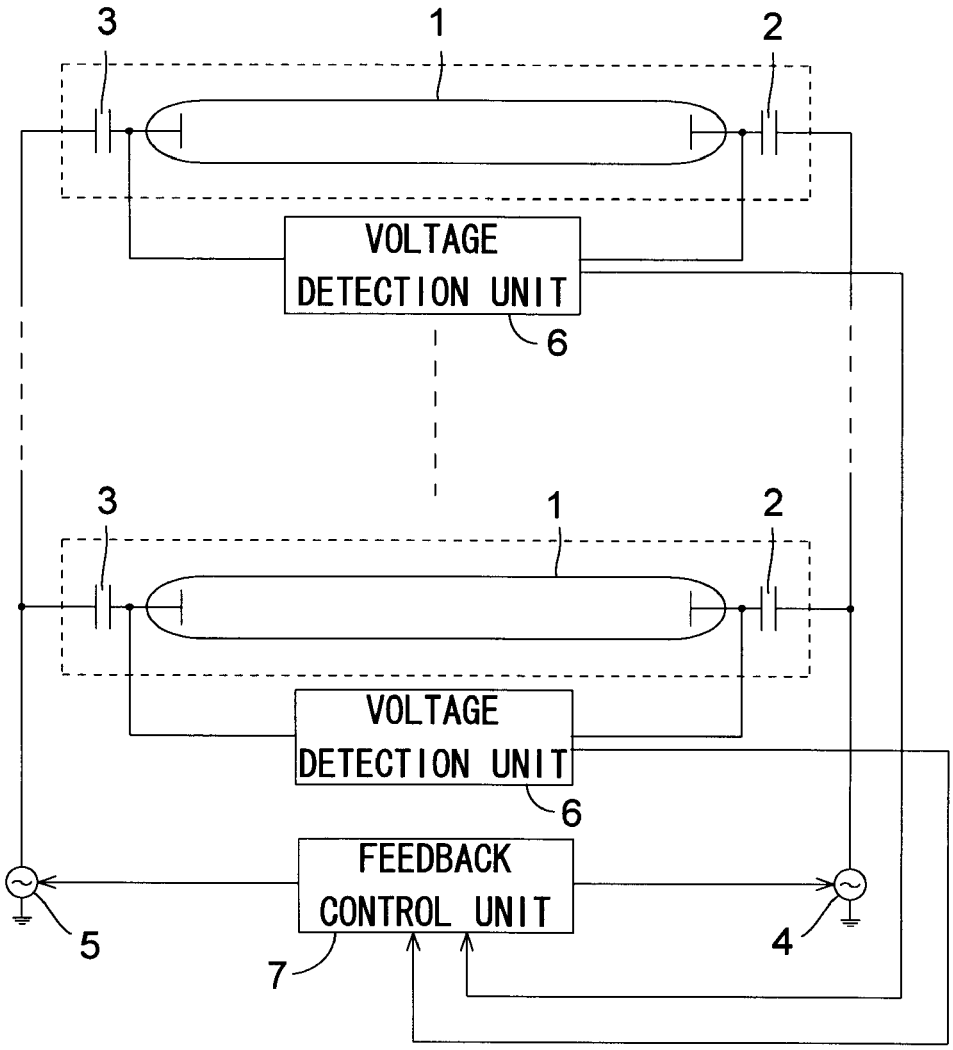
FIG. 1 is a schematic view showing the structure of a cold cathode tube lighting device according to a preferred embodiment of the present invention.
Figure 2:
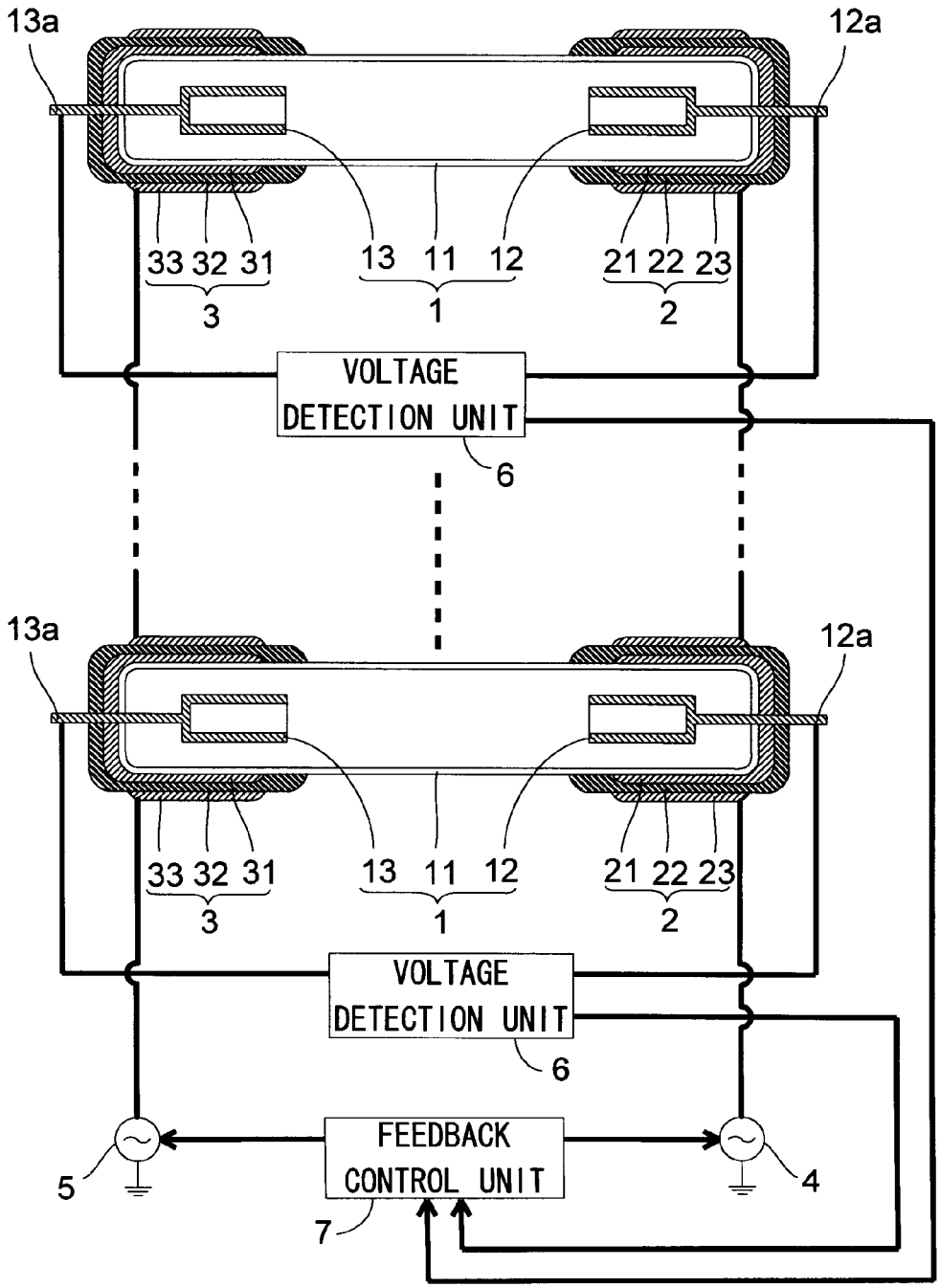
FIG. 2 is a schematic sectional view showing a discharge tube and a ballast capacitor incorporated in the cold cathode tube lighting device according to the preferred embodiment shown in FIG. 1.

As shown in FIGS. 1 and 2, the cold cathode tube lighting device according to this preferred embodiment is structured such that a plurality of discharge tubes 1 are connected in parallel. As shown in FIG. 2, each of the discharge tubes 1 preferably includes a sealed glass tube 11 and a pair of internal electrodes 12 and 13 provided inside the glass tube 11. Note that, although not shown, a fluorescent substance is preferably applied on the inner wall surface of the glass tube 11, and rare gas (a mixed gas of Ne and Ar) and mercury vapor are sealed in the glass tube 11. The internal electrodes 12 and 13 are preferably made of tungsten, and disposed in first and second end portions, respectively, of the glass tube 11. The internal electrodes 12 and 13 have lead terminals 12*a* and 13*a*, respectively.

Ballast capacitors 2 and 3 are integrally attached to first and second end portions, respectively, of the discharge tube 1. Specifically, the ballast capacitor 2 attached to one end portion of the discharge tube 1 preferably includes a cylindrical inner electrode 21 that is preferably made of aluminum and that is preferably formed directly on the outer surface of the discharge tube 1 (the glass tube 11); a cylindrical yttrium oxide dielectric layer 22 arranged so as to cover the inner electrode 21; and a cylindrical outer electrode 23 that is preferably made of aluminum and that is formed on the dielectric layer 22. The ballast capacitor 3 attached to the other end portion of the discharge tube 1, preferably has a structure that is substantially similar to that of the ballast capacitor 2, preferably includes a cylindrical inner electrode 31 that is preferably made of aluminum and that is formed directly on the outer surface of the discharge tube 1 (the glass tube 11); a cylindrical yttrium oxide dielectric layer 32 arranged so as to cover the inner electrode 31; and a cylindrical outer electrode 33 that is preferably made of aluminum and that is formed on the dielectric layer 32.

An end portion of the lead terminal 12*a* of the internal electrode 12 of the discharge tube 1 projects out through the glass tube 11 and the ballast capacitor 2, and an end portion of the lead terminal 13*a* of the internal electrode 13 of the discharge tube 1 projects out though the glass tube 11 and the ballast capacitor 3. The lead terminal 12*a* of the internal electrode 12 of the discharge tube 1 is electrically connected to the inner electrode 21 of the ballast capacitor 2, and the lead terminal 13*a* of the internal electrode 13 of the discharge tube 1 is electrically connected to the inner electrode 31 of the ballast capacitor 3. As a result, the internal electrode 12 of the discharge tube 1 and the inner electrode 21 of the ballast capacitor 2 are electrically connected to each other so as to be at the same potential, and the internal electrode 13 of the discharge tube 1 and the inner electrode 31 of the ballast capacitor 3 are electrically connected to each other so as to be at the same potential.

As shown in FIGS. 1 and 2, in each of the plurality of discharge tubes 1 connected in parallel, power is supplied to the internal electrodes 12 and 13 via the ballast capacitors 2 and 3, respectively. In this case, inverter power supplies 4 and 5, which are shared by, and supply power to, the plurality of discharge tubes 1, are electrically connected to the outer electrode 23 of the ballast capacitor 2 and the outer electrode 33 of the ballast capacitor 3, respectively. Incidentally, the inverter power supplies 4 and 5 are examples of the "power supply" according to a preferred embodiment of the present invention.

Here, in this preferred embodiment, each of the plurality of discharge tubes 1 has a voltage detection unit 6 connected thereto and arranged to detect a voltage between the internal electrodes 12 and 13. Specifically, the voltage detection unit 6 is connected to the end portion of the lead terminal 12*a* of the internal electrode 12 of the discharge tube 1 that projects out and to the end portion of the lead terminal 13*a* of the internal electrode 13 of the discharge tube 1 that projects out.

Furthermore, in this preferred embodiment, voltages detected by the voltage detection units 6 are fed to a feedback control unit 7 that is connected to the inverter power supplies 4 and 5. The feedback control unit 7 has a function of controlling the power supply to the plurality of discharge tubes 1 according to the voltages detected by the voltage detection units 6.

Next, a description will be given of the operation of the cold cathode tube lighting device of this preferred embodiment with reference to FIGS. 1 to 3.

First, as shown in FIGS. 1 and 2, the lighting operation of the cold cathode tube lighting device starts when the inverter power supplies 4 and 5 supply power to the internal electrodes 12 and 13, respectively, of the discharge tube 1. Here, power is supplied from the inverter power supplies 4 and 5 to the discharge tube 1 via the ballast capacitors 2 and 3, respectively. Note that power is supplied from the inverter power supplies 4 and 5 to all of the plurality of the discharge tubes 1 included in the cold cathode tube lighting device.

Figure 3:
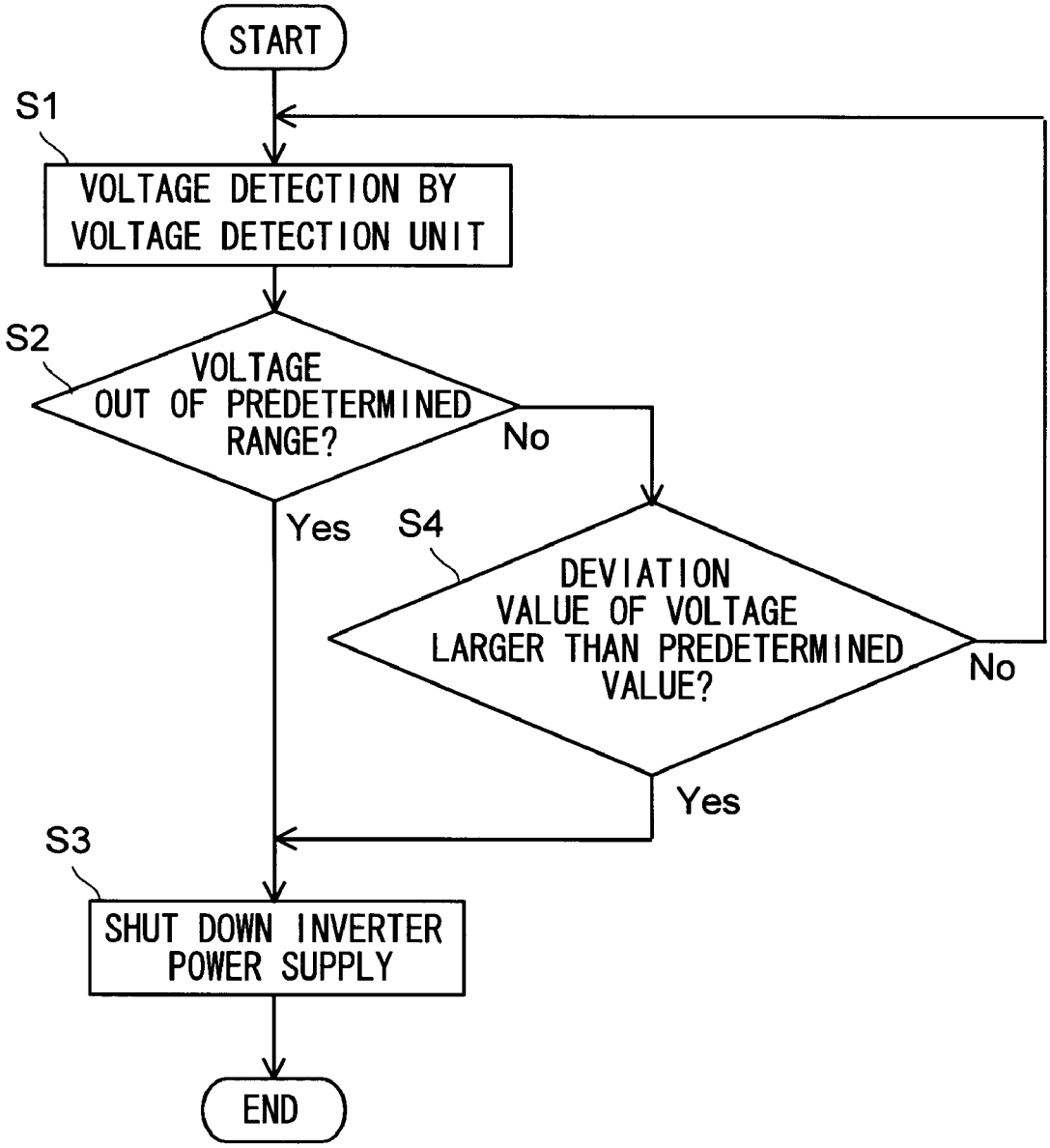
FIG. 3 is a flow chart illustrating the operation of a cold cathode tube lighting device according to a preferred embodiment of the present invention.
Figure 4:
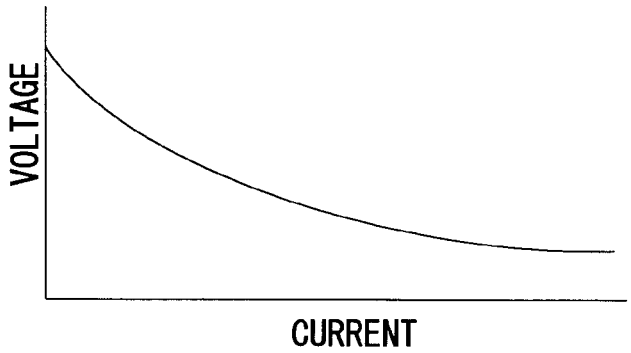
FIG.4 PRIOR ART
FIG. 4 is a diagram illustrating the characteristic of a discharge tube.
Figure 5:
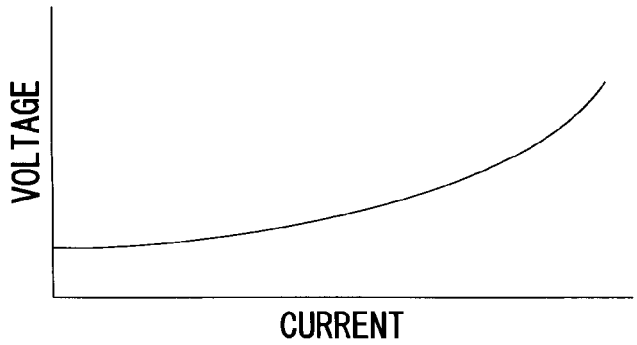
FIG.5 PRIOR ART
FIG. 5 is a diagram illustrating the characteristic of a discharge tube to which a ballast capacitor is connected.

Next, after the lighting operation of the cold cathode tube lighting device is started, the voltage detection units 6 detect voltages between the internal electrodes 12 and 13 of the discharge tubes 1 in step S1 shown in FIG. 3. Note that the voltage detection is performed by the voltage detection units 6 with respect to all the plurality of discharge tubes 1 included in the cold cathode tube lighting device. All the voltages detected by the voltage detection units 6 are fed to the feedback control unit 7.

Next, in step S2 in FIG. 3, the feedback control unit 7 judges whether or not at least one of the voltages detected by the voltage detection units 6 is out of a predetermined range. The predetermined range preferably is previously set such that a voltage (an abnormal voltage) detected by a voltage detection unit 6 that is connected to an abnormal discharge tube 1 is out of the predetermined range, and such that a voltage detected by a voltage detection unit 6 that is connected to a normal discharge tube 1 is within the predetermined range. Thus, when the feedback control unit 7 finds at least one of the voltages detected by the voltage detection units 6 to be out of the predetermined range, it means that a failure has occurred in at least one of the plurality of discharge tubes 1. On the other hand, when the feedback control unit 7 finds all the voltages detected by the voltage detection units 6 to be within the predetermined range, it means that all the plurality of discharge tubes 1 are normally operating.

In the case where the feedback control unit 7 has judged that at least one of the voltages detected by the voltage detection units 6 is out of the predetermined range, the flow goes to step S3 in FIG. 3. There, the feedback control unit 7 controls such that the power supply to the plurality of discharge tubes 1 is cut off. That is, the feedback control unit 7 shuts down the inverter power supplies 4 and 5.

On the other hand, in the case where the voltages detected by the voltage detection units 6 are all within the predetermined range, the flow goes to step S4 in FIG. 3.

Next, in step S4 in FIG. 3, the feedback control unit 7 judges whether or not a deviation value of at least one of the voltages detected by the voltage detection units 6 is larger than a previously-set predetermined value. Here, the deviation value indicates, for example, difference (deviation) from a mean value calculated from the voltages detected by the voltage detection units 6. Specifically, when the deviation value of at least one of the voltages detected by the voltage detection units 6 is determined to be larger than the predetermined value, it means that there is a large difference in brightness among the plurality of discharge tubes 1. On the other hand, when the deviation values of all the voltages detected by the voltage detection units 6 are determined to be smaller than the predetermined value, it means that all the plurality of discharge tubes 1 have almost the same brightness.

In the case where the deviation value of at least one of the voltages detected by the voltage detection unit 6 is determined to be larger than the predetermined value, the flow goes to step S3 in FIG. 3. There, the feedback control unit 7 performs control such that the power supply to the plurality of discharge tubes 1 is cut off. That is, the feedback control unit 7 shuts down the inverter power supplies 4 and 5.

On the other hand, when the deviation values of all the voltages detected by the voltage detection units 6 are determined to be smaller than the predetermined value, the flow goes back to step S1. Then, the above-described steps S1 to S4 are repeated.

In this preferred embodiment, as described above, since the voltage detection units 6 arranged to detect voltages between the internal electrodes 12 and 13 provided in the discharge tubes 1 are each connected to a respective one of the plurality of discharge tubes 1, voltages between the internal electrodes 12 and 13 in each of the plurality of discharge tubes 1 can be separately detected. Here, the power supply to the plurality of discharge tubes 1 is controlled according to the voltages detected by the voltage detection units 6. Specifically, when a failure occurs in any of the plurality of discharge tubes 1, the voltage detection unit 6 connected to such a discharge tube 1 detects an abnormal voltage, and the power supply to the plurality of discharge tubes 1 can be cut off even when the other discharge tubes 1 are normally operating. This makes it possible to prevent the cold cathode tube lighting device from continuing its lighting operation in a state in which there exist one or more discharge tubes 1 that are unlit or degraded in brightness, and thus to prevent emission-position-dependent unevenness from occurring in the brightness of light emitted from the cold cathode tube lighting device.

Since this preferred embodiment offers the above benefits, use of the cold cathode tube lighting device of this preferred embodiment as a backlight for a liquid crystal display device makes it possible to prevent degradation of the display quality of the liquid crystal display device.

Furthermore, with this preferred embodiment, as described above, since power supply to the plurality of discharge tubes 1 is cut off when at least one of the voltages detected by the voltage detection units 6 is out of the predetermined range, it is easy to cut off the power supply to the plurality of discharge tubes 1 when a failure occurs in one of the plurality of discharge tubes 1.

Furthermore, with this preferred embodiment, as described above, when the deviation value of at least one of the voltages detected by the voltage detection units 6 is larger than the predetermined value, the power supply to the plurality of discharge tubes 1 is cut off. This helps prevent the lighting operation of the cold cathode tube lighting device from continuing to be performed with considerable unevenness occurring in the brightness of the plurality of discharge tubes 1. This makes it possible to prevent emission-position-dependent unevenness from occurring in the brightness of light emitted from the cold cathode tube lighting device.

Furthermore, with this preferred embodiment, as described above, since the feedback control unit 7 to which the voltages detected by the voltage detection units 6 are fed controls the power supply to the plurality of discharge tubes 1, it is easy to control the power supply to the plurality of discharge tubes 1 according to the voltages detected by the voltage detection units 6.

The preferred embodiments disclosed herein are to be considered in all respects as illustrative and not restrictive. The scope of the present invention is set out in the appended claims and not in the description of the preferred embodiments hereinabove, and includes any variations and modifications within the sense and scope equivalent to those of the claims.

For example, the cold cathode tube lighting device of the above described preferred embodiments is preferably provided with discharge tubes each having ballast capacitors attached to one and the other end portions, respectively, but this is not meant to limit the present invention. The present invention is also applicable in a cold cathode tube lighting device provided with discharge tubes each having a ballast capacitor attached to either one or the other end portion.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A cold cathode tube lighting device, comprising:

a plurality of discharge tubes connected in parallel and each including a pair of internal electrodes;

ballast capacitors each integrally attached at least to a respective one of the plurality of discharge tubes;

a power supply arranged to supply power to the plurality of discharge tubes; and voltage detection units connected to the plurality of discharge tubes to detect voltages between the pair of internal electrodes of the discharge tubes; wherein the voltage detection units are associated with the plurality of discharge tubes on a one-to-one basis by being connected to a pair of internal electrodes of a corresponding one of the plurality of discharge tubes, each of the voltage detection units is arranged to detect a voltage between the pair of internal electrodes of the corresponding one of the plurality of discharge tubes;

power supply to the plurality of discharge tubes is controlled according to the voltages detected by the voltage detection units associated with the plurality of discharge tubes on the one-to-one basis; and the ballast capacitors each include a cylindrical internal electrode arranged directly on an outer surface of a glass tube defining one of the plurality of discharge tubes, a cylindrical dielectric layer arranged to cover the cylindrical internal electrode, and a cylindrical outer electrode arranged on the cylindrical dielectric layer.

2. The cold cathode tube lighting device according to claim 1, wherein power supply to the plurality of discharge tubes is cut off when at least one of the voltages detected by the voltage detection units is out of a predetermined range, and the predetermined range is set such that a voltage detected by any of the voltage detection units that is connected to an abnormal discharge tube of the plurality of discharge tubes is out of the predetermined range and such that a voltage detected by any of the voltage detection units that is connected to a normal discharge tube of the plurality of discharge tubes is within the predetermined range.

3. The cold cathode tube lighting device according to claim 1, wherein, when a deviation value of at least one of the voltages detected by the voltage detection units is larger than a predetermined value, power supply to the plurality of discharge tubes is cut off.

4. The cold cathode tube lighting device according to claim 1, further comprising a feedback control unit to which the voltages detected by the voltage detection units are fed, wherein the feedback control unit controls power supply to the plurality of discharge tubes.

* * * * *